United States Patent [19]

Williams et al.

[11] 4,157,847

[45] Jun. 12, 1979

[54] METHOD AND APPARATUS FOR UTILIZING ACCUMULATED UNDERGROUND WATER IN THE MINING OF SUBTERRANEAN SULPHUR

[75] Inventors: R. L. Williams; Rene L. Latiolais; John L. Gabriel, all of New Orleans, La.; Robert L. Bouis, Pass Christian, Miss.

[73] Assignee: Freeport Minerals Company, New York, N.Y.

[21] Appl. No.: 819,879

[22] Filed: Jul. 28, 1977

[51] Int. Cl.[2] ..... E21C 41/14; E21B 43/28

[52] U.S. Cl. ..... 299/6; 166/62

[58] Field of Search ..... 299/6, 4, 3; 166/272, 166/302, 303, 306, 252, 222

[56] References Cited

U.S. PATENT DOCUMENTS

| | | | |
|---|---|---|---|
| 928,036 | 7/1909 | Frasch | 299/6 |
| 1,339,621 | 5/1920 | Hebert | 299/6 |
| 1,764,538 | 6/1930 | Stewart | 299/6 X |
| 2,703,145 | 3/1955 | Hildebrandt | 166/222 |
| 2,742,091 | 4/1956 | Rotherham | 166/302 |
| 2,754,098 | 7/1956 | Lee | 299/6 X |
| 2,871,948 | 2/1959 | Normand | 166/222 |
| 2,980,184 | 4/1961 | Reed | 166/57 |
| 3,258,069 | 6/1966 | Hoffman | 166/252 |
| 3,322,195 | 5/1967 | Brown et al. | 166/314 X |
| 3,333,638 | 8/1967 | Bishop | 166/306 |
| 3,432,205 | 3/1969 | Hoffman et al. | 299/4 |
| 3,515,213 | 6/1970 | Prats | 166/252 |
| 3,525,550 | 8/1970 | Hoffman | 299/6 |
| 3,630,573 | 12/1971 | Goddin, Jr. et al. | 299/6 |
| 3,938,592 | 2/1976 | Aladiev et al. | 166/302 X |

*Primary Examiner*—Stephen J. Novosad

*Attorney, Agent, or Firm*—Fisher, Christen & Sabol

[57] ABSTRACT

Novel method and apparatus for utilizing, in the mining of subterranean sulphur by the Frasch process, the heat of water that has accumulated underground above at least a part of said subterranean sulphur from previous mining operations comprising subterraneanly recycling said accumulated underground water downwardly to contact and heat additional solid subterranean sulphur. In one embodiment further heat is added to the accumulated underground water. For example, pressurized, superheated drive water generated above ground is subterraneanly commingled with said accumulated underground water in a jet pump or ejector to further heat it and to recycle it subterraneanly.

20 Claims, 5 Drawing Figures

METHOD AND APPARATUS FOR UTILIZING ACCUMULATED UNDERGROUND WATER IN THE MINING OF SUBTERRANEAN SULPHUR

BACKGROUND OF THE INVENTION

1. Field of the Invention

The invention relates to the mining of subterranean solid sulphur by the Frasch method in which hot water is sent below to contact the sulphur and heat and liquefy it, the sulphur in liquid form is brought to the surface, and the hot water accumulates above at least a part of the subterranean solid sulphur. The invention more specifically relates to the conservation and utilization of the heat energy contained in the accumulated subterranean hot water.

2. Description of the Prior Art

Sulphur occurs in the caprock of certain salt domes along the coastal area of the Gulf of Mexico and in the offshore waters of the Gulf. The salt domes are believed to have been formed by the intrusion of salt from extremely deep lying beds of salt into the sedimentary formation of the region. The salt intrusives are circular or elliptical in cross-section and the tops of the domes vary in depth below mean sea level from less than one hundred feet to several thousand feet. The tops of some salt domes are capped with limestone, anhydrite, gypsum, or a combination of these minerals. A section of a typical salt dome is shown in FIG. 1.

In the caprock of some of the domes of this type containing limestone with other minerals present, sulphur is found in fissures, cracks, and seams. Sulphur is also occasionally present to a lesser extent in the gypsum and anhydrite associated with the limestone of the dome. All salt domes which are below the surface of the area in which they lie are covered with a layer of shale or other sediments which in essence forms the caprock into a closed container. The sulphur formation is often sandwiched between a layer of overlying barren limestone and an underlying layer of anhydrite. Underneath the anhydrite is the salt proper. Fewer than 10% of the salt domes discovered so far in the coastal region of the Gulf of Mexico have contained sulphur that is economically minable in commercial quantities.

After a dome has been discovered and has been proven to possess economically minable commercial quantities of sulphur in the caprock, the Frasch system of mining is usually initiated. In a typical system, a hole is drilled to a selected zone in the sulphur-bearing limestone by means of oil field type drilling equipment. The well, after drilling, usually is equipped with three concentric pipes within a protective casing which is cemented into the top of the caprock. Inside the outer casing a six-inch pipe is sunk through the caprock to the bottom of the sulphur deposit. The six-inch pipe is perforated with small holes in its lower end portion. Then a three-inch pipe is lowered to a point spaced a short distance from the bottom. Last, and innermost, is a one-inch pipe carrying compressed air and reaching more than half way to the bottom of the well.

Water, heated under pressure to about 325° F. (well above the normal 212° F. boiling point) is pumped down the space between the six-inch and three-inch pipes, and, during the initial heating period described above, also down the three-inch pipe. The initial heating period can extend for periods of 24 to 96 hours and water is injected during this period at the rate of 250 to 750 gallons per minute. The superheated water flows out the holes at the bottom of the six-inch pipe into the sulphur bearing deposit and moves upwardly because of the lower density of the hot water compared to the colder connate water. As the temperature of the sulphur bearing formation reaches and exceeds the melting point of the sulphur, liquid sulphur flows to the bottom of the well, as it is about twice as heavy as water. The pumping of water down the three-inch pipe is then discontinued. Static pressure of the hot water forced into the formation, plus imposed pressure within the dome, then forces liquid sulfur several hundred feet up the three-inch pipe. Compressed air forced down the smaller pipe aerates and lightens the liquid sulphur in the three-inch pipe so that it will rise the rest of the way to the surface. A single well can take the sulphur from only about a half acre of dome area. So new wells must be drilled continually, and new pipelines laid to bring in water and air and carry off the molten sulphur. Other pipe sizes may be used, but this in no way changes the general theory of Frasch mining. A mining system of the Frasch type is disclosed in U.S. Pat. No. 1,612,453.

Since the caprock of the salt dome is essentially a closed container, the injection of hot water for mining purposes will build up the pressure in the dome unless relieved. Relief is accomplished by drilling "bleedwells" to the floor of the dome and removing cold water. Cold water—as cold as practical—is removed to conserve heat in the dome and to maintain the desired mine pressure. In the course of time, large quantities of hot water accumulate in the upper regions of the dome in the barren areas and leached areas (i.e., areas from which substantially all of the sulphur has been removed). The injection of millions of gallons of hot water (325° F.) into the hydraulically closed domes, with the removal of cold water for pressure control, has resulted in the accumulation of trillions of BTU's of heat within the domes. The fluid densities within the caprock are such that the hot water rises as it exits the well bottom, and percolates upwardly through the sulphur-rich limestone. Although the water is cooling as it gives up its heat to the melting sulphur and the surrounding formations, it is still very hot when it enters the formations above the sulphur ore. In fact, temperatures in the range of 220° F. to 290° F. are frequently measured in this spent water near the top of caprock. From this description, it can be seen that, in a typical Frasch process mine, a large limestone caprock exists with the lower portions containing elemental sulphur enrichment within the limestone matrix and with the upper portions containing a vast induced geothermal resource of hot water accumulated from past and ongoing mining operations. A large group of wells can be drilled into the lower portion of the caprock with virgin hot water being injected to continue the sulphur melting process.

The large volumes of water removed through the bleedwells, usually located on the flanks of the dome in order that the water removed is the coldest possible water in the formation, can present a problem. The disposal of this water is a primary environmental problem.

Water, thus returned to the earth's surface (hereinafter designated as bleedwater), is still at an elevated temperature, and in addition to the usual constituents of ground waters such as chlorides, sulphates and bicarbonates of sodium, calcium and magnesium, contains hydrogen sulphide, thiosulphates, hydrosulphides and polysulphides, and other sulphur compounds of various basic elements (which will be designated hereinafter simply as sulphides) and various other dissolved substances. The sulphides and the other constituents in the bleedwater render it highly corrosive and extremely destructive to the usual materials encountered in the commercial operation of a sulphur mine, making its re-use entirely uneconomical.

The re-use, without treatment, of the bleedwater would require all conduits and equipment with which it came in contact to be made of special noncorrosive material, which is extremely costly. Commercial recovery of the heat in bleedwater has been attempted using a closed type of heat exchanger in which the bleedwater flows over conduits carrying colder fresh water, the heat transfer being from the bleedwater through the conduit material and into the fresh water. Only a small part of the heat can be commercially recovered in this manner and the heat exchangers must be constructed of costly non-corrosive materials.

The fundamental problem in the re-use of hot bleedwater for mining is that not only the bleedwater reheating plant, but also the water distribution pipelines and production wells are subjected to severe corrosion and scaling. U.S. Pat. No. 2,109,611 illustrates one attempt to treat bleedwater to render it suitable for re-use. Where, in some cases, the corrosion problem might be reduced by the use of additives, or chemical treatment, these methods result in substantially higher operating expenses.

It has, therefore, been customary to attempt to locate the bleedwells so as to return to the surface as cold a bleedwater as possible and to discharge this water to waste. This practice has accounted for great losses by the sulphur mining industry in the past because of the non-recovery of the heat from the bleedwater, by the inability to re-use the bleedwater and by loss of heat due to the flow of the hot mine water to the upper formations of the deposit where it is no longer available for melting sulphur in situ. The disposal of the bleedwater thus produced is subject to the further disadvantage that the suspended and dissolved matter, hydrogen sulphide and metal sulphides contaminate the surface water into which the bleedwater may be permitted to flow. In order to prevent objectionable pollution, then, it is necessary to purify the bleedwater before its discharge. The apparatus and process of purification before disposal impose a heavy expense upon the sulphur mining industry.

The re-use of bleedwater brought to the surface could provide tremendous economic and environmental benefits. Several unsuccessful efforts have been made in this direction. Excessive scaling and corrosion, however, have caused many of these operations to be uneconomical.

In some instances in the past sulphur wells have been pumped with their liners bleeding water to the atmosphere, creating concurrent flows of sulphur and water. Heat is supplied to such wells by injecting hot minewater down through the caprock casing. The very aggressive nature of the bleedwater renders this technique highly corrosive to the liner and the sulphur delivery pipe. In addition, a considerable quantity of heat is lost to the atmosphere and the large amounts of bleedwater at the surface present serious pollution problems.

U.S. Pat. Nos. 3,525,550; 3,432,205; and 3,258,069 describe methods and apparatus which seek to take advantage of natural hot geopressured aquifers disposed below subterranean sulphur deposits and depend upon special geological formation that may be rare or difficult and expensive to locate. U.S. Pat. No. 3,432,205 circulates hot water down one well and through the sulphur-bearing formation to a second well, upwardly through which moves a mixture of sulphur and hot water and produces large amounts of corrosive water which must be disposed of. U.S. Pat. No. 3,630,573 describes an attempt to reduce the amount of hot water injected into a sulphur well by separately injecting superheated steam and hot water. U.S. Pat. No. 1,339,621 discloses an air lift specially designed in the shape of a Venturi to give rising molten sulphur an extral lift. The methods and apparatus of these patents, however, do not utilize subterranean recycling of hot water to conserve and use the large amount of heat in the subterranean accumulated hot water resulting from subterranean sulphur mining operations.

U.S. Pat. No. 3,938,592 describes a method for extracting heat from subterranean rock strata which have been fractured by one or more explosions and filled with stratal fluid to absorb heat from the rock strata. The heated stratal fluid is then recycled upwardly to heat a heat-carrying agent which is recycled through a heat exchanger to a surface plant where the heat values may be utilized. U.S. Pat. No. 3,333,638 refers to the disposal of water from a gas-producing zone to a lower water-absorbing zone. U.S. Pat. No. 3,515,213 refers to the recovery of shale oil by circulating hot water from the surface through the shale and back to the surface again using two wells. U.S. Pat. Nos. 2,742,091; 2,871,948; 2,980,184 and 3,322,195 all relate to various treatments of oil wells to rejuvenate them and obtain additional production. U.S. Pat. No. 2,742,091 discloses a method in which hot oil is recycled within the well or casing. None of these patents disclose or suggest the mining of sulphur wherein the subterranean hot water accumulations from previous mining operations are subterraneanly recycled downwardly to heat underlying sulphur for liquefying it.

SUMMARY AND BROAD DESCRIPTION OF THE INVENTION

The present invention provides a method and apparatus for reclaiming the heat stored in sulphur-bearing domes which have been mined for years and which contain enormous quantities of hot water that have accumulated over the years mainly as a result of sulphur mining. The method and apparatus of this invention are also of value in conserving and more fully utilizing hot mine waters in new mines (in which little or no hot water has accumulated). The method and apparatus of this invention permit large fuel savings in the mining of underground sulphur as compared to the conventional Frasch hot process heretofore employed quite extensively throughout the sulphur mining undustry. The invention also permits considerable reductions in the volume of new water and new heat needed for the sulphur-mining operations and, as a consequence, also provides large reductions in the volume of bleedwater required to be removed, treated and/or disposed of. In the method and apparatus of this invention, most of the accumulated underground water remains in the formation and corrosion and scaling of surface equipment is avoided or minimized. The present invention provides for significantly reduced subterranean sulphur mining costs and can permit the continued operation of heretofore marginal wells, mining areas and mines, ultimately permitting greater sulphur recovery.

It is a purpose of this invention to recover and re-use the heat of the hot underground water accumulated from ongoing and/or previous sulphur mining operations without bringing the water to the surface. The invention is especially applicable to the Frasch mining process wherein hot water having a temperature sufficiently high to liquefy sulphur is pumped underground to contact the subterranean sulphur-bearing ore to heat it and ultimately convert the solid sulphur contained by the ore to liquid sulphur which is then brought to the surface. In heating the sulphur-bearing ore, some of the heat of the hot water is spent and the water is somewhat reduced in temperature but remains hot and accumulates in large quantities underground. The spent hot water remains hot underground because of the insulating nature of the formation which surrounds it. Because of its lower specific gravity compared to liquid sulphur and cooler connate waters the spent hot water rises in the formation, e.g., in the leached or barren zones of the caprock, and accumulates in the upper regions thereof. The present invention comprises a method of and apparatus for subterraneanly recycling the accumulated hot water to the lower, sulphur-enriched, productive zones of the formation where it contacts and contributes heat to additional solid sulphur.

The present invention is not limited to any particular means for subterraneanly recycling the accumulated underground water and includes any pumping device which is capable of moving water and/or heat directly from the upper portions to the lower portions of the formation or caprock. Some devices for accomplishing this are: ejectors, inductors, or jet-type pumps, powered by water, or steam through a supply line; submerged electric pumps powered by electricity through a supply cable; submerged hydraulic pumps; submerged fluid turbines, powered by water, steam or air; positive displacement pumps powered by a mechanical torque shaft, reciprocating pumps or other devices that will accomplish the recycling function. Suitable jet pumps for use in this invention are available from Kobe, Inc., Huntington Park, California 90255 and other pumping device manufacturers.

A salient point of this invention is that it provides for the direct recycling of accumulated underground water, which may be warm to hot, from the upper levels to the lower levels of the formation without first returning the recycling accumulated underground water to the surface. The pumping device is lowered into a well drilled into the sulphur-bearing ore formation or caprock, and its suction inlet, in one embodiment, is positioned within the zone of accumulated underground water desired to be recycled. As energy is supplied to the pump the accumulated underground water is drawn into the pump, forced down the well through piping provided therefor and discharged through perforated pipelines into the lower portions of the formation where the sulphur-bearing ore is located. Additional heat can be added to the system by using a jet pump or turbine and hot virgin water as the drive or power fluid.

The invention also includes the addition of heat to the accumulated underground water being recycled to raise its temperature, if a higher temperature is needed or desired for the recycling accumulated water. In some instances, as in wells in areas or formations where sulphur mining has been ongoing from some time, the accumulated water is hot and its temperature is sufficiently high to liquefy the solid sulphur efficiently and economically and the addition of no further heat is needed or desired. For example, the accumulated water in the formation may be in the range of about 120° F. to about 300° F. or higher. On new wells just being started the accumulated underground water, which may be mostly connate water, initially may have much lower temperatures. Normally, it would be more costly to heat surface water at ambient temperatures than it would be to heat accumulated hotter underground water. Sulphur melts in the range of about 235° F. to about 246° F. depending upon its solid form. The temperature of the hot water brought into contact with it must exceed the melting point of the solid sulphur being mined and, for a reasonably rapid melting rate, it should be exceeded by at least a few degrees. In general, the temperature of the hot water brought into contact with the sulphur is in the range of about 250° F. to about 330° F. or higher if desired or practical, and preferably in the range of about 260° F. to about 320° F.

The addition of heat, if necessary or desired, to the accumulated underground water can be accomplished in any suitable manner. For example, steam, virgin hot water, or hot gases, such as combustion gases, can be delivered from the surface and subterraneanly mixed with the accumulated underground water to heat it. In some cases electrical heating coils or other electric heating devices may be used.

In one embodiment, both the recycling and heat addition are accomplished with an underground fluid turbine, jet, ejector or inductor pump having its suction inlet located in the zone of accumulated underground water to be recycled. The pump is driven or powered by pressurized virgin hot water pumped from the surface. For example, a conventional power plant used to generate virgin hot water for sulphur mining usually delivers the virgin hot water to be wellsite at a pressure of about 150 to about 300 psig. In this embodiment, a booster pump is used to increase the pressure of the virgin hot water to not more than about 2000 psig and preferably into the range of about 500 to about 1000 psig and inject it into tubing connected to the downhole jet pump. There the virgin hot water powers (drives) the jet pump drawing accumulated underground water into the pump where it commingles or blends with the virgin hot water to produce a mixture of the two having a higher temperature than the accumulated underground water and sufficiently high to melt the underground solid sulphur. Representative broad and narrow temperature ranges are shown below:

| | Narrow Ranges | Broad Ranges |
|---|---|---|
| Hot Mining Water (Power or Drive Water) | about 300° to 320° F. | about 250° to 400° F. |
| Accumulated Underground Water | about 260° to 280° F. | about 120° to 300° F. |
| Mixture | about 260° to 320° F. | about 250° to 330° F. |

The mixture of the accumulated underground water and the virgin hot water is then injected by the jet pump into the sulphur-bearing ore and the liquid sulphur produced is withdrawn to the surface through adjacent tubing.

In another embodiment, the virgin hot water is delivered from the surface and subterraneanly mixed with the accumulated underground water in order to add heat, but is not used to drive the fluid turbine, jet, ejector or inductor pump. This can be accomplished, for example, by injecting the virgin hot (about 250°–400° F.) water generated at the surface into the liner of the well assembly but outside the tubing connected to the fluid turbine, jet, ejector or inductor pump so as to cause the accumulated underground water to commingle or blend with said injected virgin hot water as both are drawn into the suction inlets of the down-hole pump thus increasing the temperature of the water delivered to the wellsite to the desired range of about 250°–330° F. In this embodiment, the downhole pump is driven by steam, hot gases, such as combustion gases, or some other suitable fluid.

In yet another embodiment, a first portion of the virgin hot water is delivered from the surface and subterraneanly mixed with the accumulated underground water in order to add heat while, at the same time, a second portion of said virgin hot water is used to drive said fluid turbine, jet, ejector or inductor pump. This can be accomplished, for example, by injecting said first portion of the virgin hot water into the liner of the well assembly but outside the pump tubing so that this portion is drawn in through the pump suction inlets together with accumulated underground water, and injecting said second portion of the virgin hot water into the tubing connecting the downhole pump so that this second portion drives said downhole pump. This embodiment also results in the simultaneous recycling of accumulated underground water and heat addition.

Injection of virgin hot water into the well assembly liner for the purpose of adding heat also has the advantage of allowing the operator to control the downhole wellsite water temperature without having to change the pickup ratio of the down-hole pump. The latter normally entails the retrieval of the pumping device to the surface, a time-consuming and burdensome operation.

The embodiments described above utilize a single well; however, multiple wells or well groupings can be used in carrying out the present invention. For example, one well can be equipped only with the means for recycling the accumulated underground water to form the liquid sulphur pool while one or several other wells can simply bring the liquid sulphur up to the surface. These other wells need not be equipped with booster water lines; for example, they may be equipped with a compressed air line for the air lift and a liquid sulphur delivery line. However, one or more or all of these other wells can be of the conventional type equipped with booster water lines and operated with recycled heat provided by recycled accumulated underground water from one well equipped with means for doing so pursuant to this invention.

The suction inlet of the pump used to recycle the accumulated underground water can be located in, or connected to, the zone of accumulated underground water existing above at least a portion of solid sulphur in the sulphur-bearing ore being mined and the discharge outlet of the pump can be located in, or connected to, the zone of sulphur-bearing ore below the accumulated underground water desired to be recycled. In this case, the accumulated underground water being recycled enters the pump, moves downwardly through the pump, or the pump and its connections, and is discharged into the sulphur-bearing ore zone below.

Alternatively, the suction inlet of the pump can be located in, or connected to, the sulphur-bearing ore zone below with its discharge outlet located in, or connected to, the accumulated underground water zone above. In this instance, water is drawn into the pump or its inlet connections from the sulphur-bearing ore zone, is moved upwardly through the pump, or the pump and its connections, and is discharged into the accumulated underground water zone. This causes accumulated underground water to flow downwardly through the formation outside of the pump and its connections into the sulphur-bearing zone.

The concept of this invention of recycling domal water within the production formation without bringing it to the surface is a departure from previous attempts to reclaim the heat stored in such waters in older domes. The injection of millions of gallons of hot water (325° F.) over a period of many years into hydraulically closed domes being mined for sulphur, with only cold water removed for pressure control, resulted in the accumulation of trillions of BTU's of heat within these formations. Previous attempts to reclaim this heat involved the domal water being brought to the surface and re-injected. For many years, the return of this water to the surface for treatment, storage and reheating has been the subject of intense study. This corrosively aggressive fluid known as bleedwater has repeatedly proven to be an illusive resource for reclamation. Processes for the re-use of accumulated hot bleedwater from caprock have been tested and have generally proved to be uneconomical and impractical due to excessive scaling and corrosion characteristics of bleedwater. This invention circumvents these problems by eliminating the need to handle hot bleedwater at the surface.

The present invention reduces the amount of new heat required to mine sulphur by the hot water process and is capable of improving the efficiency of existing installations.

The present invention precludes the need for returning this hot water resource to the surface for processing before re-use. It provides for the introduction of "new" heat while recycling "old" heat to more productive zones in the caprock. It also reduces the impact to the environment by reducing the quantity of water bled from traditional Frasch process mining operations for disposal. In fact, as much as about 50% less water can be bled from a typical formation when the method of this invention is used than when conventional Frasch mining is carried out without the method of this invention. Even less water might be bled in some cases.

DESCRIPTION OF THE DRAWINGS

In FIGS. 3–5 the flow of sulphur is shown by broken line arrows and the flow of water is shown by solid line arrows.

DETAILED DESCRIPTION OF THE INVENTION

Figure 1:
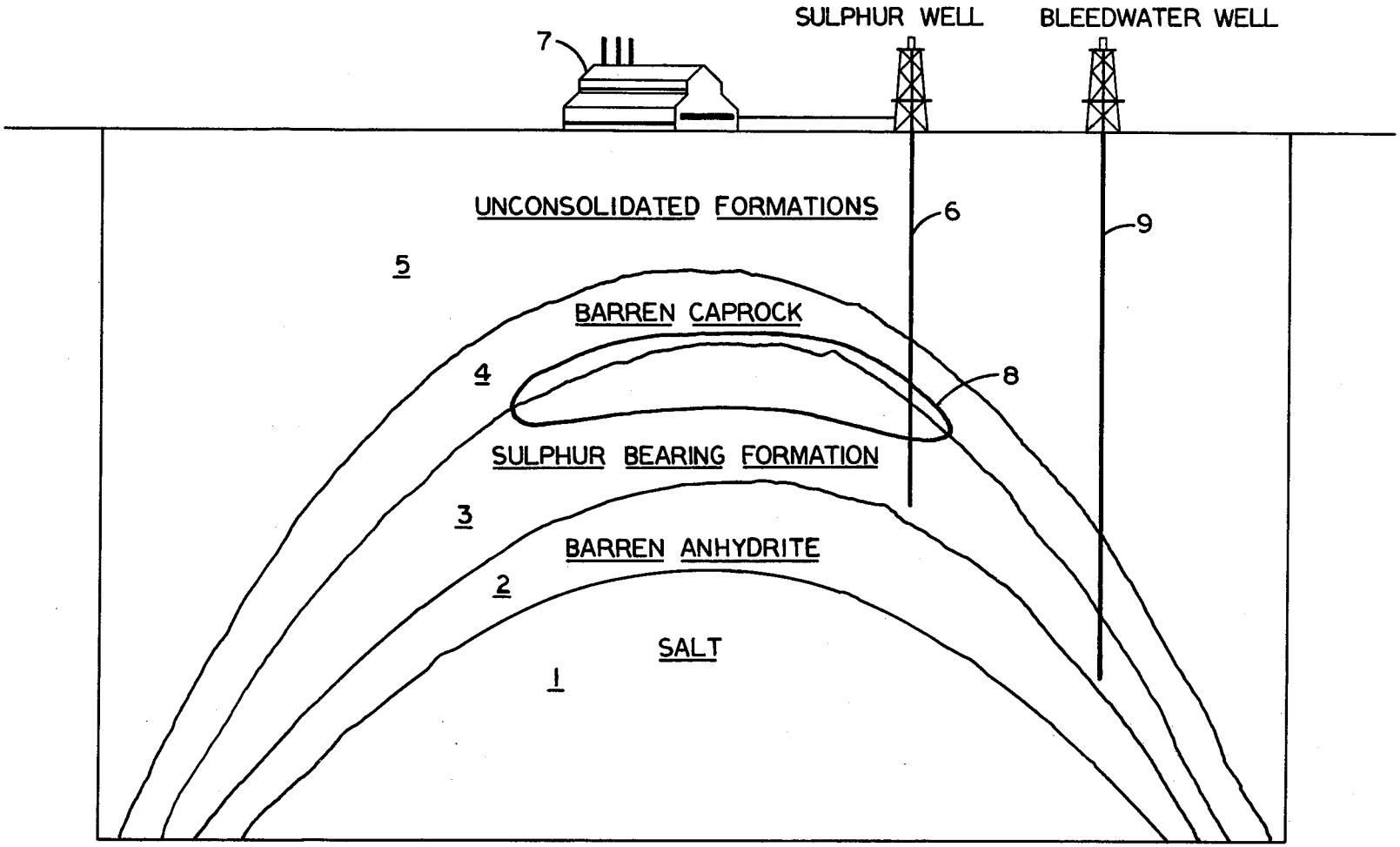
FIG. 1 is a diagrammatic vertical sectional view of a salt dome formation containing a sulphur-bearing ore illustrating a typical prior art system for mining sulphur by the Frasch hot process.

FIG. 1 illustrates diagrammatically the structure of a salt dome formed with a sulphur-bearing formation. The salt dome is indicated by reference numeral 1. Over the top of the salt dome lies a barren anhydrite zone 2 over which lies the sulphur-bearing formation 2 which usually comprises sulphur-bearing limestone. Over the sulphur-bearing formation 3 is a barren caprock 4 which contains little or no sulphur. As shown in FIG. 1, the remaining material between the barren caprock and the surface are miscellaneous unconsolidated formations 5.

A surphur well 6 is supplied with hot water and compressed air by the plant 7. Because of past sulphur mining operations, a zone or reservoir 8 of hot water has accumulated underground in the upper areas of the sulphur-bearing formation 3 from which upper areas most, if not all of the sulphur has been removed by previous mining operations, and in the lower portions of the barren caprock 4. This reservoir of hot accumulated underground water 8 usually has a temperature of about 220° F. to about 290° F. and represents a considerable amount of stored heat.

A bleedwater well 9 is provided in the prior art procedure for the purpose of regulating the pressure within the salt dome and to permit the continued operation of the sulphur well 6. The bleedwater taken from well 9 is highly corrosive presenting a disposal problem. It is not suited for use in boilers or heat exchangers because of its highly corrosive nature and because of its severe scaling properties.

EXAMPLE A

This is not an example of the present invention; it illustrates the prior art.

Figure 2:
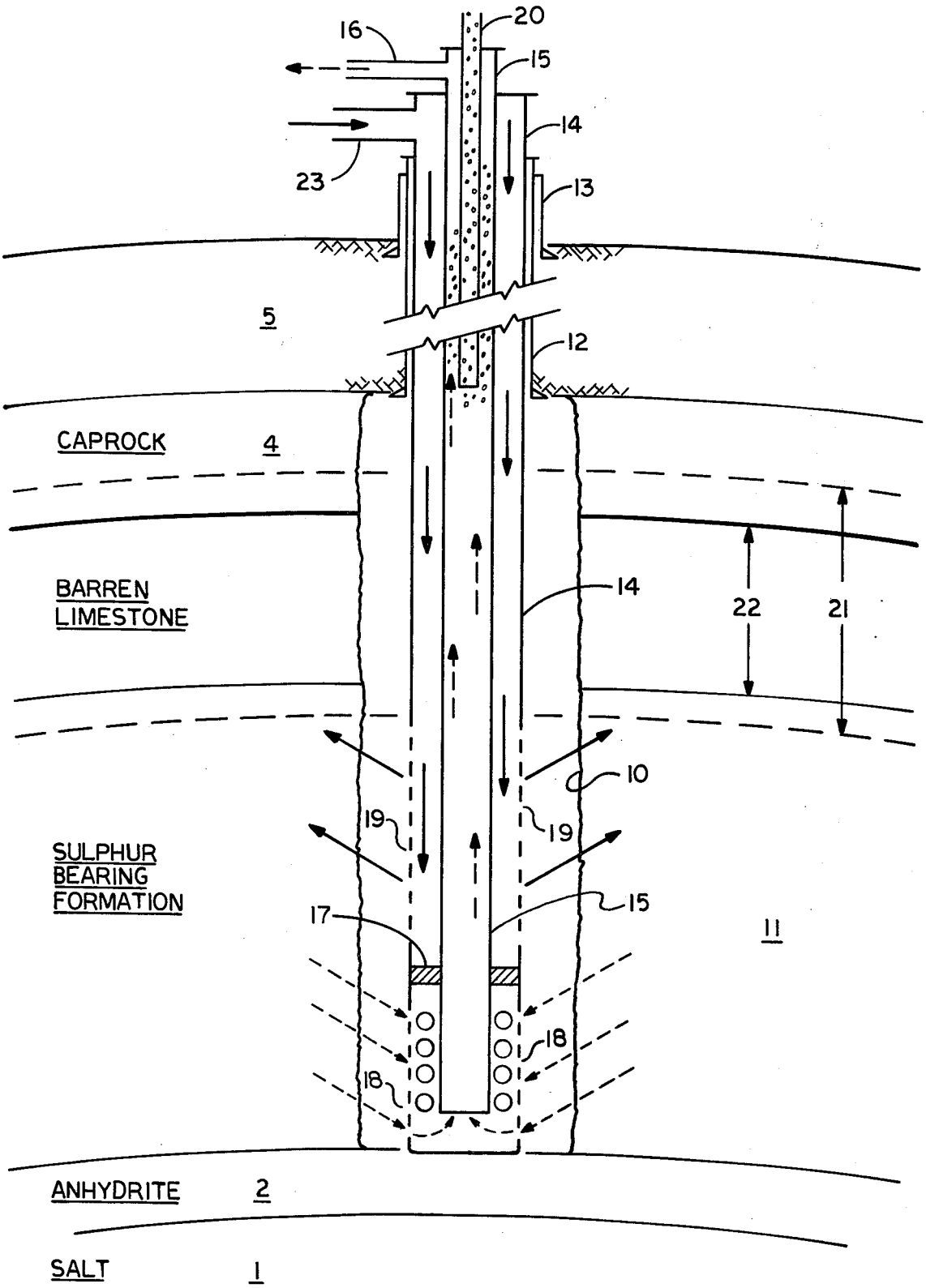
FIG. 2 is a diagrammatic vertical sectional view of a prior art sulphur well utilizing the Frasch hot process.

FIG. 2 provides further detail of a prior art sulphur well. A drill hole 10 having a diameter of about 12.5 inches is sunk about 1643 feet (vertical depth of about 1594 feet) to the bottom of the sulphur-bearing formation 11 and is provided with a caprock casing 12 (about 8⅝ inch O.D. and about 1321 feet long) and a surface casing 13 (about 10.75 inch O.D. and about 787 feet long). A liner 14 (about 1643 feet long and about 6⅝ inch O.D.) extends from the top to the bottom of the drill hole 10. The lower fifteen feet or so of the liner wall is perforated so as to permit the passage of fluid through the wall. Within the liner, there is provided a sulphur return pipe 15 (about 3.5 inch O.D.) which is open at the bottom and extends to the surface where it is connected to other piping 16 which carries the sulphur to a suitable storage area. The open end of sulphur return pipe 15 is disposed near the bottom of the drill hole 10, i.e., at a vertical depth of about 1588 feet A plate seal 17 is disposed within the liner 14 near its bottom and extends from the interior wall of the liner to the exterior wall of the sulphur return pipe 15, thus, sealing the upper portions from the lower portions of the liner. The lower portion of the liner is provided with a plurality of perforations 18 which permit molten sulphur to enter the liner and travel to and into the open bottom of sulphur return pipe 15. A portion of the liner above the plate seal 17 is provided with perforations 19 which permit hot water sent down the liner to exit from the liner and enter into the sulphur-bearing formation 11 adjacent the drill hole 10. A compressed air pipe 20 (about 0.75 inch nominal) extends into sulphur delivery pipe 15 for the purpose of introducing air into the molten sulphur rising therein, thereby providing lift to the molten sulphur to assist its ascension in pipe 15. As mining proceeds in the well shown in FIG. 2, a body 21 of warm to hot water accumulates in the upper strata of the formation in the areas of the barren limestone 22, the lower portions of the barren caprock 4 and in some cases the upper portions of the sulphur-bearing formation 11. In order to maintain the pressure within the formation at a suitable level to permit continued injection of water through the space between the liner 14 and the delivery pipe 15, bleed wells 9 (see FIG. 1) bleed off water in those areas where it is expected to be the coolest as diagrammatically illustrated in FIG. 1.

In the operation of the prior art systems shown in FIGS. 1 and 2, hot water having a temperature of 250° F. to 350° F. is produced in a power plant on the surface and supplied to the liner 14 through pipe 23. The hot water is forced down the sulphur well shown in FIG. 2 through the annular space existing between liner 14 and sulphur delivery pipe 15. The hot water exits through the liner wall through perforations 19 and comes into contact with the sulphur in the sulphur-bearing formation 11. After the heating up period during which hot water is continually pumped down through the liner 14 and initially down through sulphur delivery pipe 15, the sulphur in the sulphur-bearing formation 11 begins to melt and forms a pool of molten sulphur at the bottom of liner 14. The flow of hot water through pipe 15 is discontinued. Subsequent volumes of hot water sent down through liner 14 and contacting the sulphur-bearing formation melt additional amounts of sulphur.

After contacting the sulphur-bearing ore, the hot water is somewhat cooled but still has a high enough temperature (e.g. 280° F.) relative to connate water to rise in the formation and become situated in the upper areas of the formation where it becomes trapped. The exact location of the trapped body of warm or hot water 21 is not precisely critical to the invention described or claimed herein. For example, it may or may not extend into the caprock strata 4 and it may or may not reside in the sulphur-bearing formation 11. The molten sulphur produced by the hot water enters the liner 14 through perforations 18 and eventually enters the open lower end of pipe 15 in which it rises due to the internal pressure in the formation caused by pumping down hot water through the liner 14 and control of said internal pressure through the bleeding off of bleedwater through the bleedwater well 9. The compressed air coming down through air supply pipe 20 (for example at a pressure of 440 psig) is injected into the molten sulphur in pipe 15 and reduces the specific gravity of the contents of pipe 15 causing said contents to rise and flow out through piping 16 to a suitable sulphur collecting reservoir (not shown). In a typical operation (after start-up) of the well shown in FIG. 2, an average of about 2.1 tons per hour of sulphur is produced using an average flow of hot water through liner 14 of 135 gallons per minute having an average temperature of 319° F. and an average pressure of 190 psig. This is equivalent to 3,838 gallons of the 190 psig water per ton of sulphur produced, and represents an input of energy of 8.43 million BTU per ton of sulphur produced.

The heat contained by the body of accumulated underground hot water 21 has not been utilized to any significant degree in prior sulphur wells utilizing the Frasch hot process and, in many cases, has been accumulating for many years. The body of accumulated underground hot water 21 has an average temperature of about 280° F. and constitutes a resource of heat which is some cases amounts to trillions of BTU's.

EXAMPLE 1

Figure 3:
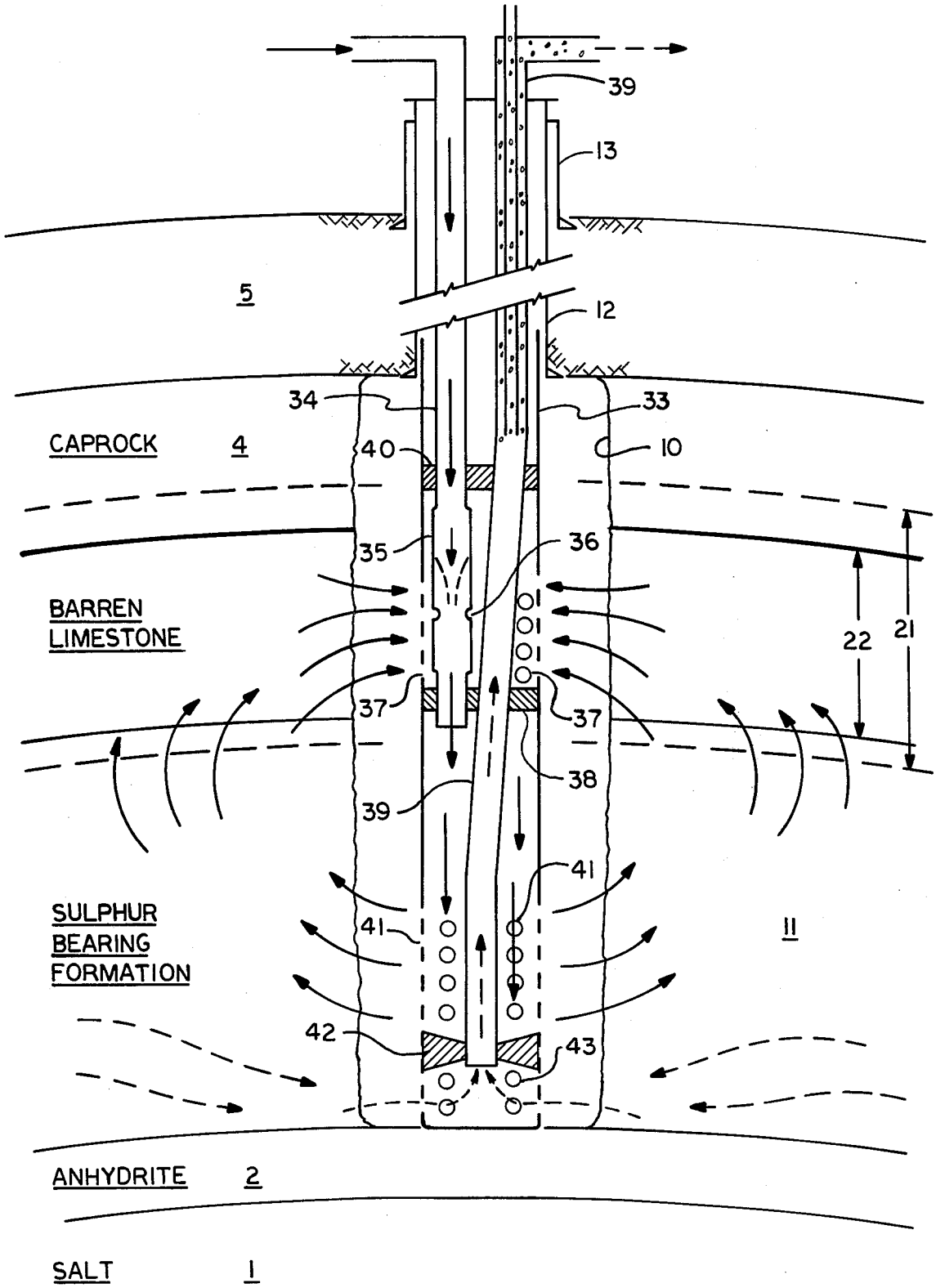
FIG. 3 is a diagrammatic vertical sectional view of a sulphur well illustrating an embodiment of the present invention.

The present invention, an embodiment of which is shown in FIG. 3, utilizes and reclaims the heat stored in the body of accumulated underground hot water 21 of old wells and reduces the amount of hot water needed to sustain new or young wells. FIG. 3 illustrates an embodiment of the invention that accomplishes this purpose utilizing the drill hole 10 shown in FIG. 2 after pipes and liners shown in FIG. 2 except the caprock casing 12 and surface casing 13 have been removed. As diagrammatically shown in FIG. 3, the drill hole 10 as described in relation to FIG. 2 is sunk an additional two feet (approx.) into the sulphur-bearing formation 11. A bobtail liner 33 (about 329 feet long) is inserted into the drill hole 10 and extends from above the caprock 4 down into the sulphur-bearing formation 11 as far down as approximately the bottom of the drill hole 10, i.e., the liner 33 extends in drill hole 10 from a vertical depth of about 1286 feet to a vertical depth of about 1595 feet. A drive water pipe 34 extends down into the liner 33. The lower end of the drive water pipe 34 is connected to a pumping device such as a jet pump 35 formed with suction inlets 36 that are located within the body of accumulated underground water 21. The jet pump 35 extends downwardly from a vertical depth of about 1371 feet. The lower end of the jet pump 35 or piping connected to it extends to a vertical depth of about 1381 feet.

Figure 4:
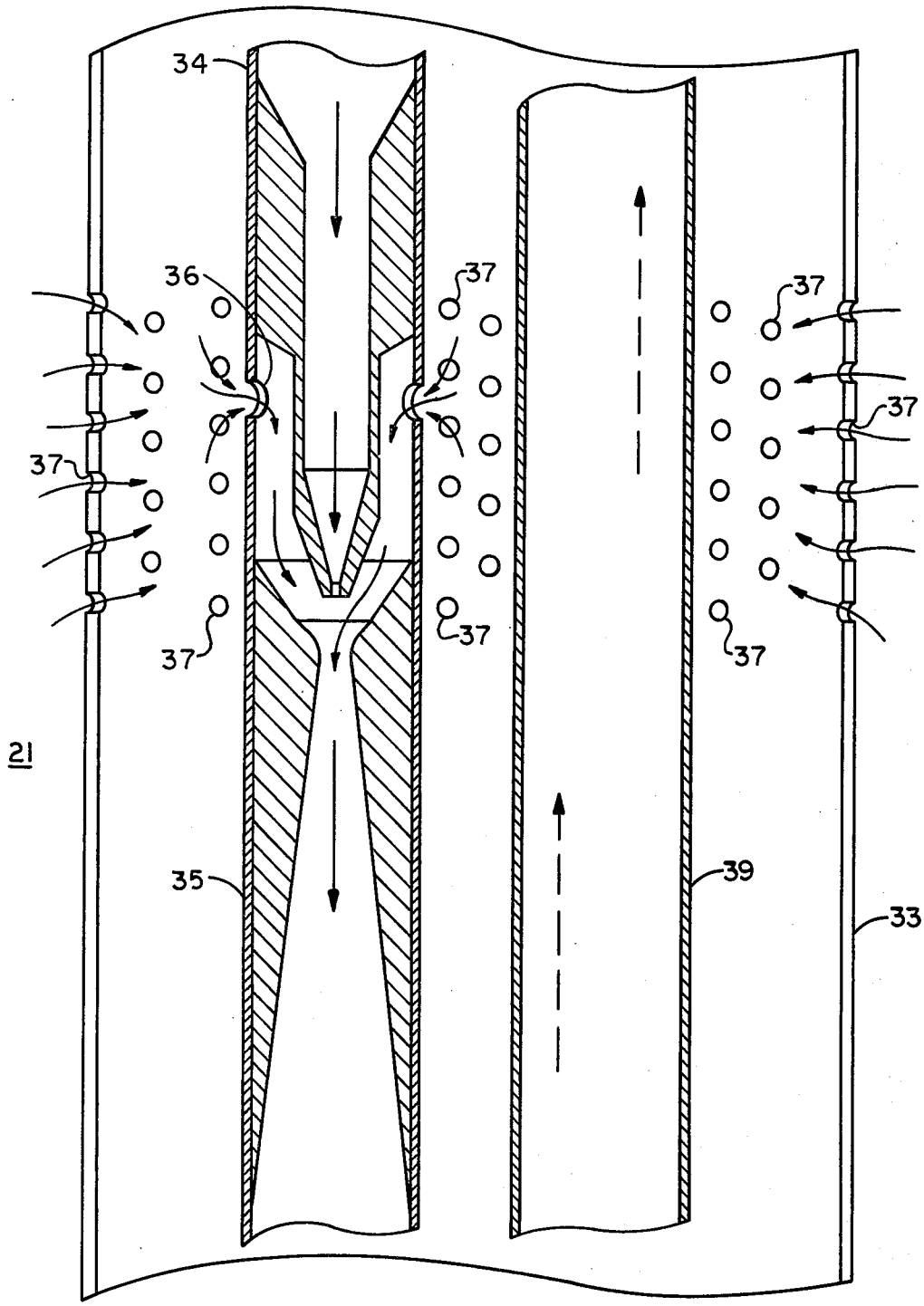
FIG. 4 is a fragmentary, diagrammatic sectional view of a portion of the well shown in FIG. 3 illustrating in more detail the jet pump employed in FIG. 3.

FIG. 4 illustrates diagrammatically in more detail the structure of the jet pump utilized in the embodiment of FIG. 3. A jet pump of any suitable structure can be employed as jet pump 35. In fact, any suitable pump can be used in place of the jet pump 35. The operation of jet pumps is well known and a wide variety of suitable jet pumps are available in the market place. Any other suitable pump can be employed if desired.

The liner 33 has an O.D. of about 7 inches and is provided with perforations 37 to allow the water of the body 21 to pass through the liner 33 and enter the suction inlets 36 of the jet pump 35. A screen (now shown) preferably may cover the perforations 37 to prevent clogging of the jet pump 35. A seal 38 is provided at a vertical depth of about 1380 feet within the liner 33 to seal its inner wall below its perforations 37 to the outer walls of drive water pipe 34 and a sulphur return pipe 39 (O.D. of about 2.875 inches) which extends through the liner almost to the bottom of the drill hole 10, i.e., to a vertical depth of about 1588 feet. A seal 40 can also be provided within the liner 33 to seal the internal wall of the liner 33 to the external walls of drive water pipe 34 and sulphur return pipe 39 at a point above jet pump 35. The two seals 38 and 40 help to ensure that the accumulated underground water entering through perforations 37 will enter the suction inlets 36 rather than flowing up or down the liner 33. Of course, if virgin hot water is injected into liner 33, as called for by some of the embodiments of the invention, then seal 40 is not provided or, if provided, is preferably equipped with a oneway valve (not shown) or similar device so as to permit the virgin hot water to flow down past the seal through liner 33 but not up through it. The lower sections of liner 33 are provided with additional perforations 41 for approximately 9 or 10 feet above a seal 42 (located at a vertical depth of about 1586 feet) which seals the inner walls of the liner 33 to the external walls of sulphur return pipe 39. Below the seal 42 the liner 33 is provided with perforations 43 through which molten sulphur can flow into the liner and upwardly through pipe 39.

In operation, pressurized hot mining water, e.g., at a temperature of about 319° F. and a pressure of about 690 psig is pumped down through drive water pipe 34 to the jet pump 35 which it enters and drives to pump water from the accumulated underground body of water 21 down through the lower portions of the jet pump 35 into the liner 33 below seal 38 and thence downwardly and outwardly through perforations 41 into the sulphur-bearing formation 11 where the water again contacts the sulphur in the formation to melt it. The pressure of the pressurized hot mining water can be varied depending on such factors as the depth of the formation and sulphur deposit. Usually, it will be not more than about 2,000 psig, and preferably between about 500 and 1000 psig. The molten sulphur enters the liner 33 through perforations 43, enters the sulphur return pipe 39 and rises in said return pipe. A compressed air line 44 extends down into sulphur return pipe 39 and provides an air lift to assist the ascension of molten sulphur in pipe 39. There results a recycling of water from the accumulated underground water body 21 through perforations 37 into the liner 33 and into the jet pump 35 through perforations 36 and thence downwardly through jet pump 35 and its connection, if any, past the seal 38 and into the liner 33 (in which it flows downwardly) to perforations 41 through which it flows outwardly into contact with additional sulphur in the formation. The water cools somewhat and rises in the formation and ultimately may reach the body 21 of accumulated underground water once more. If desired or necessary, the drive water being pumped through pipe 34 can be heated to an elevated temperature such as 319° F. in order to increase the melting efficiency of the water of the accumulated underground water 21 being recycled down through jet pump 35 into contact with additional sulphur in the sulphur-bearing formation.

In a typical operation of a well according to this invention as described above in conjunction with FIGS. 3 and 4, an average of about 2.4 tons per hour of sulphur is produced utilizing an average flow of hot water through drive water pipe 34 of about 30 gallons per minute at an average temperature of about 319° F. and an average pressure of 650 psig. This is equivalent to 1,234 gallons of the 650 psig water per ton of sulphur produced, and represents an input of energy of 2.72 million BTU per ton of sulphur produced. A comparison of these results with those obtained in Example A on the same sulphur deposit 11 and the same drill hole 10 clearly shows the advantages of this invention which not only can produce more sulphur with considerable less volume of hot minewater sent down the well, but can result, as in this case, in a reduction of the energy input per ton of sulphur of more than 5.7 million BTU. This represents a considerable savings in the amount if heat needed to continue operation of the well to produce an equivalent amount of sulphur and greatly reduces the amount of bleedwater that must be removed for pressure control and thus greatly reduces the problems of bleedwater disposal.

Figure 5:
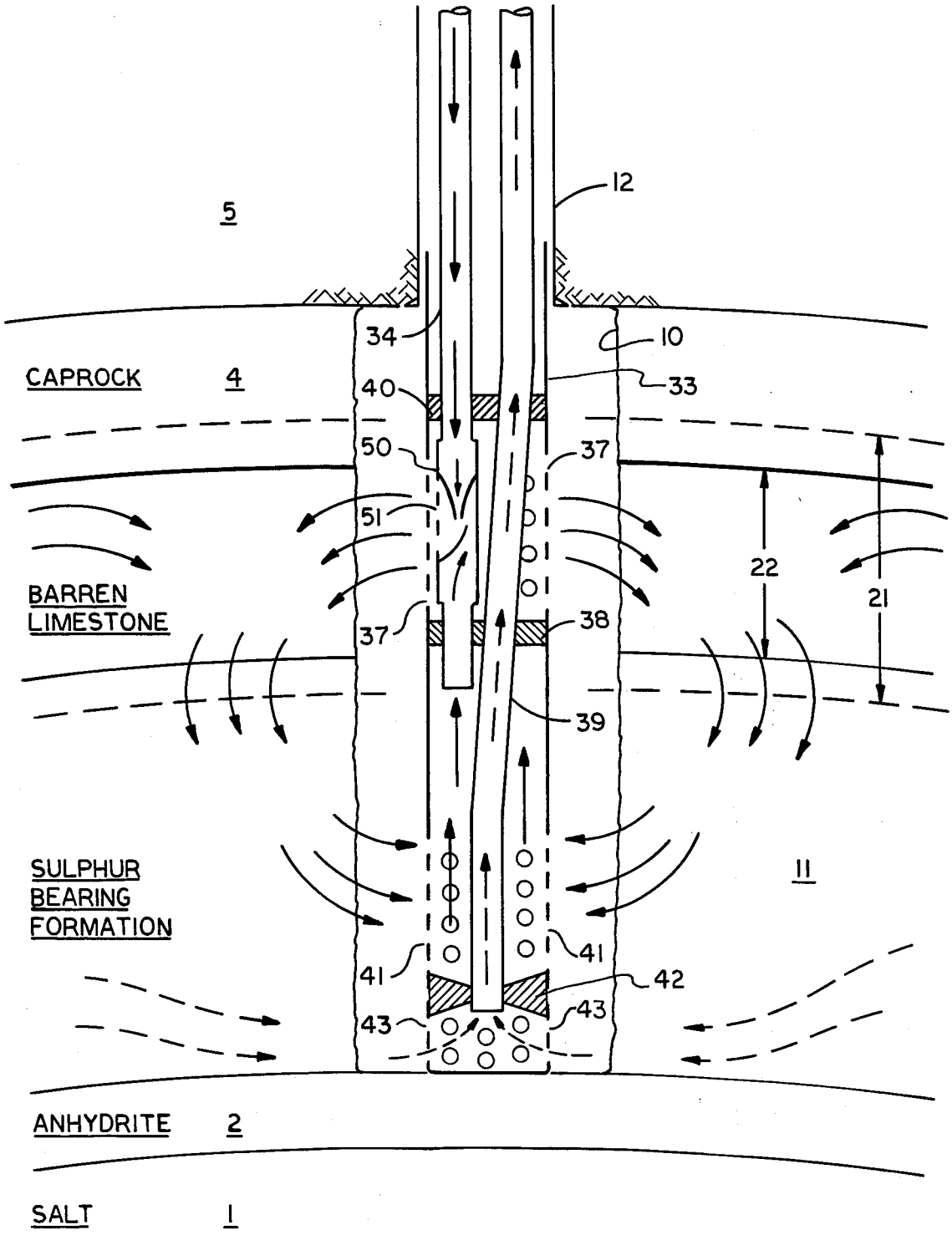
FIG. 5 is a diagrammatic vertical sectional view of a portion of a sulphur well illustrating another embodiment of this invention.

An alternate embodiment of the invention is shown in FIG. 5, wherein the accumulated underground water is caused to flow downwardly through the formation, which is different from the embodiment of FIGS. 3 and 4 wherein the accumulated underground water is caused to flow downwardly through the pump 35 or its connections, if any. In this embodiment a different type of jet pump 50 is used. In this case the suction inlet of the pump is connected to the interior of liner 33 below seal 38 and the discharge outlet of the pump is directed through the liner 33 into the body of accumulated underground water 21. Thus, water is drawn into the liner 33 through perforations 41 and rises through the liner 33. The water ascending liner 33 is drawn into jet pump 50 and forced through perforations 51 in the pump wall into the liner 33 through perforations 37 through the liner wall and into the body of accumulated underground water 21. This is believed to build up pressure in body 21 causing flow downwardly in the formation to bring hot or warm water from said body into contact with sulphur in the ore.

Various modifications and variations to the invention will be obvious to those skilled in the art and may be practiced without departing from the scope of this invention.

What is claimed is:

1. In a method of mining sulphur from a sulphur-bearing ore in a subterranean formation wherein hot water at a temperature sufficiently high to liquefy said sulphur underground is contacted therewith to heat it and convert it to liquid sulphur which is thereafter moved to the surface whereby said hot water is somewhat reduced in temperature and accumulates as a body of underground water above at least a part of said sulphur-bearing ore, that improvement utilizing the heat of said accumulated underground water, comprising, subterraneanly moving said accumulated underground water downwardly directly from said body of accumulated underground water to said sulphur-bearing ore to contact and heat additional sulphur-bearing ore.

2. Improvement as claimed in claim 1 wherein additional heat is added to said accumulated hot water underground.

3. Improvement as claimed in claim 1 wherein said accumulated underground water is additionally heated underground by mixing it underground with water having a higher temperature than said accumulated underground water.

4. Improvement as claimed in claim 3 wherein said higher temperature water is pressurized and employed as the drive fluid in a jet pump having a suction inlet disposed in said accumulated underground water.

5. Improvement as claimed in claim 1 wherein said accumulated underground water is moved downwardly through piping provided therefor and discharged to contact said sulphur-bearing ore.

6. Improvement as claimed in claim 1 wherein said accumulated underground water is moved downwardly through said formation to contact said sulphur-bearing ore.

7. Improvement as claimed in claim 1 wherein said accumulated underground water is moved downwardly by commingling it with hot mining water from the surface and delivering the commingled water to said sulphur-bearing ore.

8. Improvement as claimed in claim 7 wherein said hot mining water is delivered to said underground sulphur-bearing ore through piping and wherein said commingling of said accumulated underground water with said hot mining water is effected by pumping means provided within said piping.

9. Improvement as claimed in claim 8 wherein the suction inlet of said pumping means is located within the zone where said underground water is accumulated.

10. Improvement as claimed in claim 9 wherein said accumulated underground water entering said inlet of said pumping means is at a temperature between about 120° F. and about 300° F. and wherein said commingled water is delivered to said sulphur deposit at a temperature between about 250° F. and about 360° F.

11. Improvement as claimed in claim 10 wherein the temperature of said hot mining water is in the range of about 250° F. to about 400° F.

12. Improvement as claimed in claim 1 wherein pressurized steam is employed as the drive fluid in a jet pump having a suction inlet disposed in said accumulated underground water.

13. A sulphur well for mining sulphur in a subterranean ore body by melting said sulphur underground and transporting it to the surface wherein a body of warm to hot underground water injected in prior mining operations has accumulated above at least a portion of said ore body, comprising: (a) a liquid sulphur passage having an inlet through which sulphur flows upwardly from said ore body to the surface; and (b) pumping means for pumping said accumulated warm to hot underground water downwardly directly from said body of accumulated hot water to said ore body to contact and heat and melt additional sulphur in said ore body, said pumping means cooperating with said passage to provide liquid sulphur at said inlet.

14. In apparatus for mining a subterranean sulphur-bearing ore body by liquefying the sulphur including means for piping it to the surface, wherein a zone of underground hot water accumulates above at least a portion of said sulphur-bearing ore body, the improvement comprising, means for subterraneanly moving a portion of said accumulated hot water downwardly directly from said zone to said ore body to contact and heat sulphur-bearing ore below said zone.

15. Apparatus for mining underground sulphur in an underground sulphur-bearing ore comprising piping means for delivering hot water from the surface into contact with said underground ore whereafter said hot water rises and accumulates underground above at least a portion of said ore, said water being at a temperature sufficiently high to liquefy the sulphur in said underground ore which it contacts, and means for subterraneanly recycling said hot water that accumulates underground above said underground ore downwardly through at least a part of said piping means to contact and heat additional ore.

16. Apparatus as claimed in claim 15 wherein said means for recycling comprises a jet pump having a suction inlet in or connected to said accumulated underground water and a discharge outlet in or connected to said ore body below.

17. Apparatus as claimed in claim 16 wherein said piping means is connected to said jet pump to deliver said hot water from the surface to said jet pump to power same.

18. Apparatus as claimed in claim 15 wherein there is also included means for delivering the liquefied sulphur to the surface.

19. Apparatus as claimed in claim 18 wherein said means for deliverying the liquefied sulphur to the surface is disposed in a separate well.

20. Apparatus as claimed in claim 15 wherein said jet pump has its suction inlet in or connected to said ore body and has its discharge outlet in or connected to said accumulated underground water.

* * * * *